US005973249A

United States Patent [19]

Liao

[11] Patent Number: 5,973,249

[45] Date of Patent: Oct. 26, 1999

[54] BONGOS HOLDER

[75] Inventor: Tsun-Chi Liao, Taichung, Taiwan

[73] Assignee: Hwa Shin Musical Instrument Co., Ltd., Taichung, Taiwan

[21] Appl. No.: 09/162,358

[22] Filed: Sep. 29, 1998

[51] Int. Cl.[6] ..... G10D 13/02

[52] U.S. Cl. ..... 84/421; 84/422.1; 84/422.2

[58] Field of Search ..... 84/421, 422.1, 84/422.2, 422.3

[56] References Cited

U.S. PATENT DOCUMENTS 4,829,874 5/1989 Hoshino ..... 84/421
5,645,253 7/1997 Hoshino ..... 248/181.1
5,685,258 11/1997 Liao ..... 84/421
5,703,306 12/1997 Liao ..... 84/421
5,804,747 9/1998 Chen ..... 84/327

*Primary Examiner*—William M. Shoop, Jr.
*Assistant Examiner*—Kim Lockett
*Attorney, Agent, or Firm*—Bacon & Thomas, PLLC

[57] ABSTRACT

A bongos holder includes a U-shaped holder base having a mounting rod fastened to a tripod, a packing plate coupled to one vertical side wall of the holder base, a holding down device driven to force the packing plate in holding down the block between the two drums of a bongos in the holder base, a clamping plate fixed to the holder base at the desired elevation by a wing nut to top the block of the bongos from upward movement, and a supporting member fixed to the mounting rod at the desired elevation by a tightening up wing screw to support the drums of the bongos.

4 Claims, 7 Drawing Sheets

BONGOS HOLDER

BACKGROUND OF THE INVENTION

The present invention relates to a bongos holder for holding a bongos for beating.

When playing a bongos, the two drums of the bongos are retained between the legs and beaten with the hands. Because the two drums of the bongos are retained between the legs when playing, the player will soon have a pain in the legs and the knees. In order to eliminate this problem, a bongos holder was invented for installing in a tripod to hold a bongos. This bongos holder, as shown in FIG. 1, has a fastening belt with hook means for securing the block between the two drums of the bongos in place. However, this structure of bongos holder is still not satisfactory in function. When beating the drums, the bongos tends to be forced to oscillate (be biased to the side where the drum is beaten).

SUMMARY OF THE INVENTION

The present invention has been accomplished to provide a bongos holder which eliminates the aforesaid problem. It is one object of the present invention to provide a bongos holder which holds the bongos firmly in place, preventing the drums of the bongos to be oscillated with the beating of the user's hands. It is another object of the present invention to provide a bongos holder which holds the bongos firmly in place without causing a damage to the drums of the bongos. To achieve these and other objects of the present invention, there is provided a bongos holder comprised of a U-shaped holder base having a mounting rod fastened to a tripod, a packing plate coupled to one vertical side wall of the holder base, a holding down device driven to force the packing plate in holding down the block between the two drums of a bongos in the holder base, a clamping plate fixed to the holder base at the desired elevation by a wing nut to top the block of the bongos from upward movement, and a supporting member fixed to the mounting rod at the desired elevation by a tightening up wing screw to support the drums of the bongos.

DETAILED DESCRIPTION OF THE PREFERRED EMBODIMENT

Figure 1:
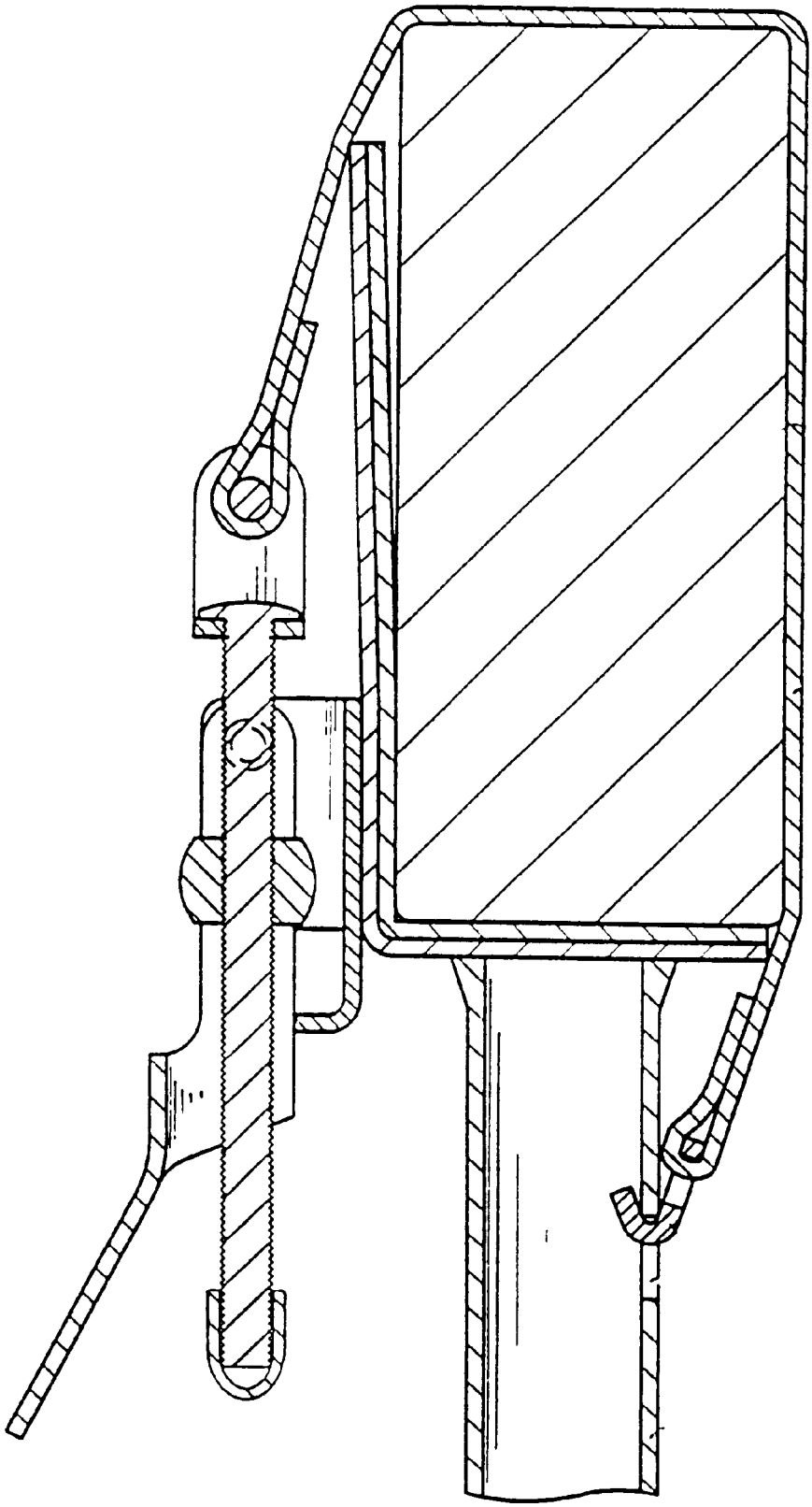
Fig.1 PRIOR ART
FIG. 1 is a sectional view of a bongos holder according to the prior art.
Figure 2:
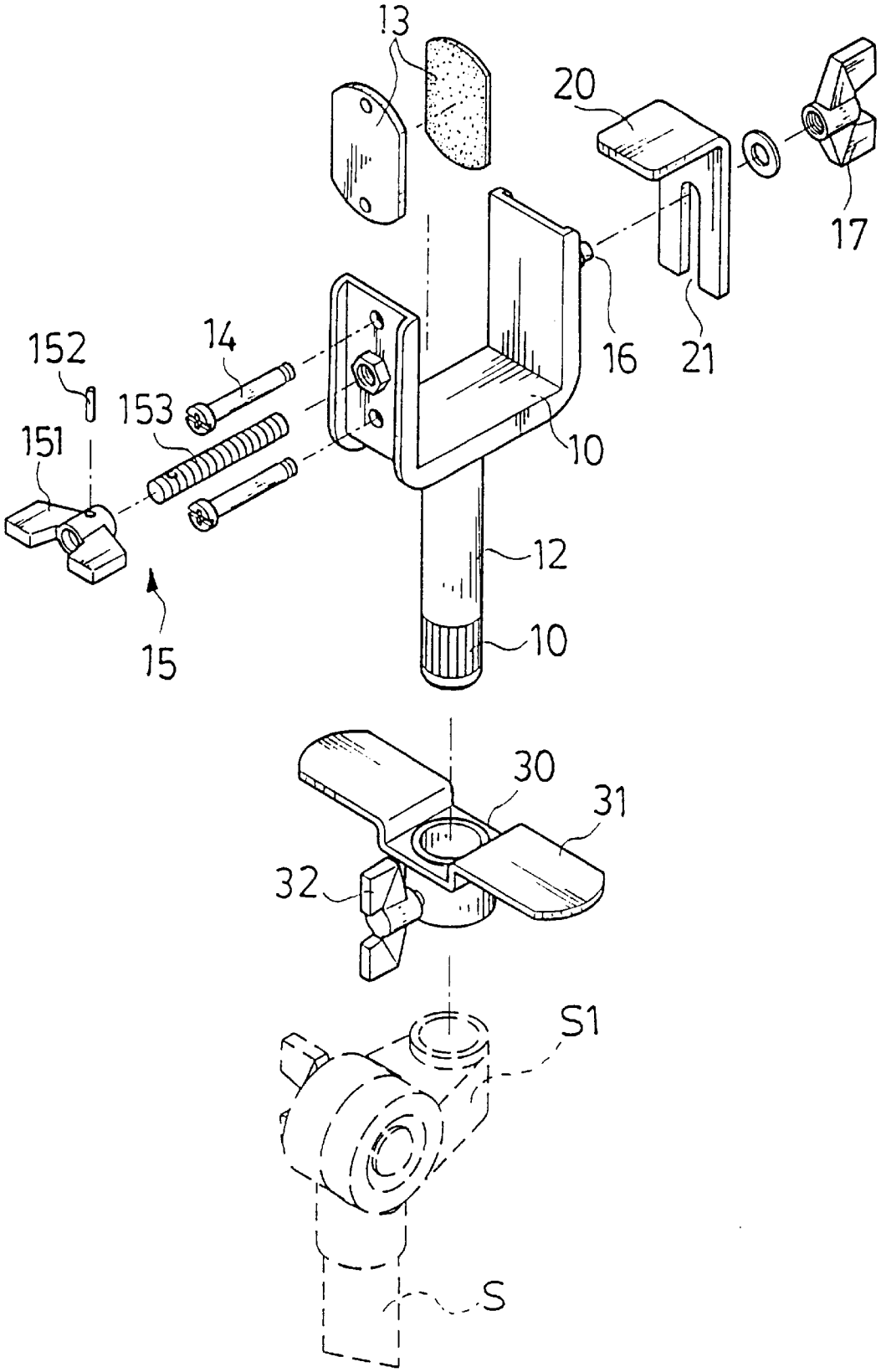
FIG. 2 is an exploded view of a bongos holder according to the present invention.
Figure 3:
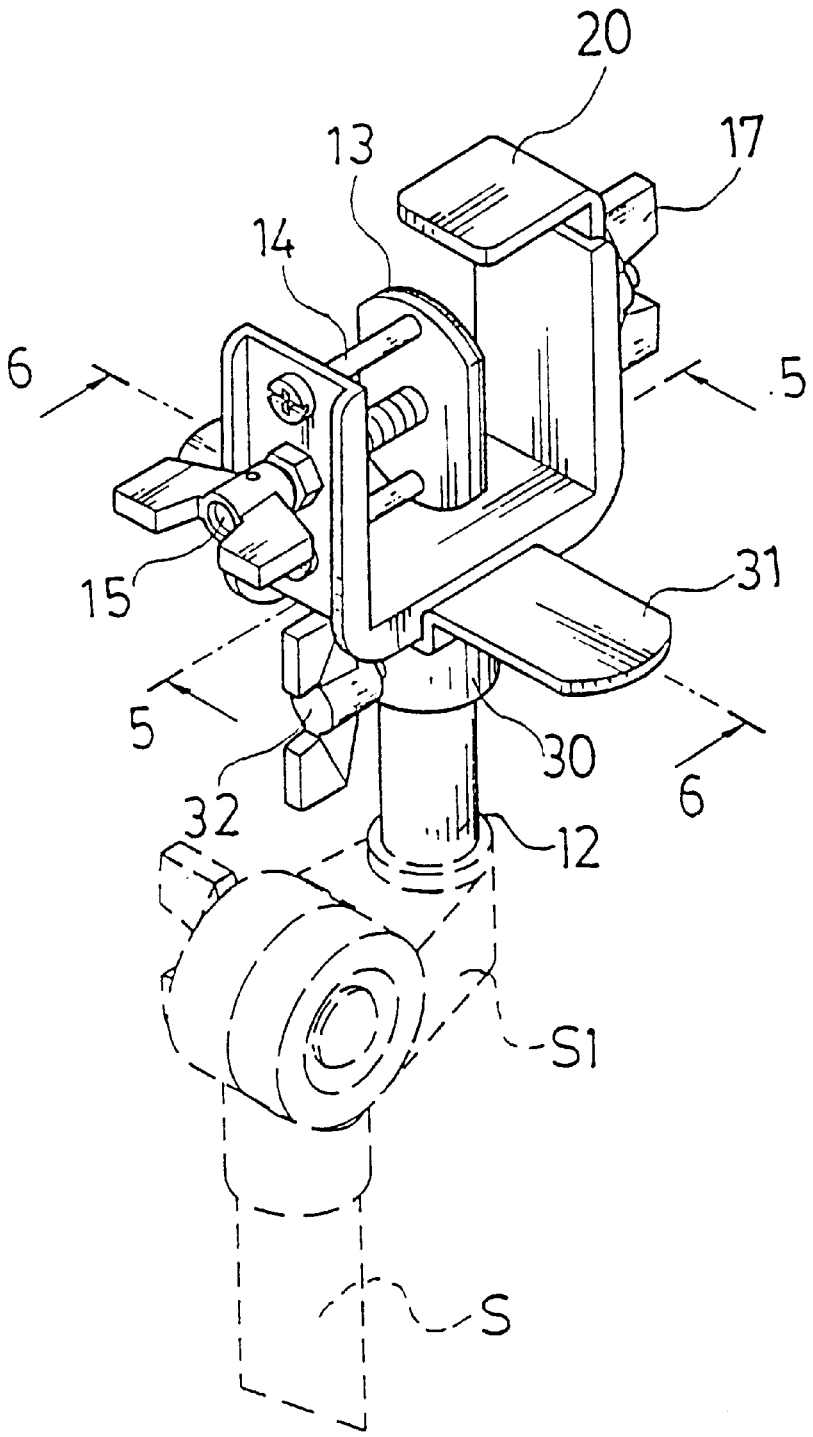
FIG. 3 is a perspective assembly view of the present invention.

Referring to Figures from 2 through 4, a substantially U-shaped holder plate 10 is shown having a screw rod 16 perpendicularly outwardly raised from its one vertical side wall (namely, the first vertical side wall). A wing nut 17 is threaded onto the screw rod 16 to fix a substantially L-shaped clamping plate 20 to the holder base 10 at one side. The L-shaped clamping plate 20 has a horizontal section and a vertical section connected at right angles, and a downwardly extended mounting slot 21 on the middle of the vertical section. When the vertical section of the L-shaped clamping plate 20 is attached to one vertical side wall of the holder plate 10, the horizontal section of the L-shaped clamping plate 20 is suspended above the holder base 10, and the screw rod 16 is inserted through the downwardly extended mounting slot 21 and screwed up with the wing nut 17. When the wing nut 17 is loosened, the clamping plate 20 can be moved up and down to the desired elevation and then fixed in position by fastening up the wing nut 17 again. A downward mounting rod 12 is integral with the horizontal bottom wall of the U-shaped holder base 10, having a toothed bottom end 11 for connecting to an angle-adjustable connector SI at the top of a tripod S. A packing plate 13 is coupled to one vertical side wall (namely, the second vertical side wall) of the U-shaped holder base 10 on the inside by two bolts 14, and moved with the bolts 14 horizontally back and forth. The packing plate 13 is comprised of a rigid base layer fixedly fastened to the bolts 14, and a flexible cover layer covered on the rigid base layer. A holding down device 15 is installed in one vertical side wall (the second vertical side wall) of the U-shaped holder base 10 between the bolts 14. The holding down device 15 is comprised of a screw rod 153 threaded into a screw hole at the corresponding vertical side wall (the second vertical side wall) of the U-shaped holder base 10 and perpendicularly stopped against the rigid base layer of the packing plate 13, a wing nut 151 threaded onto one end of the screw rod 153 outside the U-shaped holder base 10, and a lock pin 152 fastened to the wing nut 151 and the screw rod 153 to fixedly secure the wing nut 151 and the screw rod 153 together. Further, the two vertical side walls of the holder base 10 each have two guard flanges perpendicularly raised from the border thereof at two opposite sides.

A supporting member 30 is slidably mounted around the mounting rod 12 and fixed to the mounting rod 12 at the desired elevation by a tightening up wing screw 32, having two horizontal wings 31 raised from the periphery at tow opposite sides.

Figure 4:
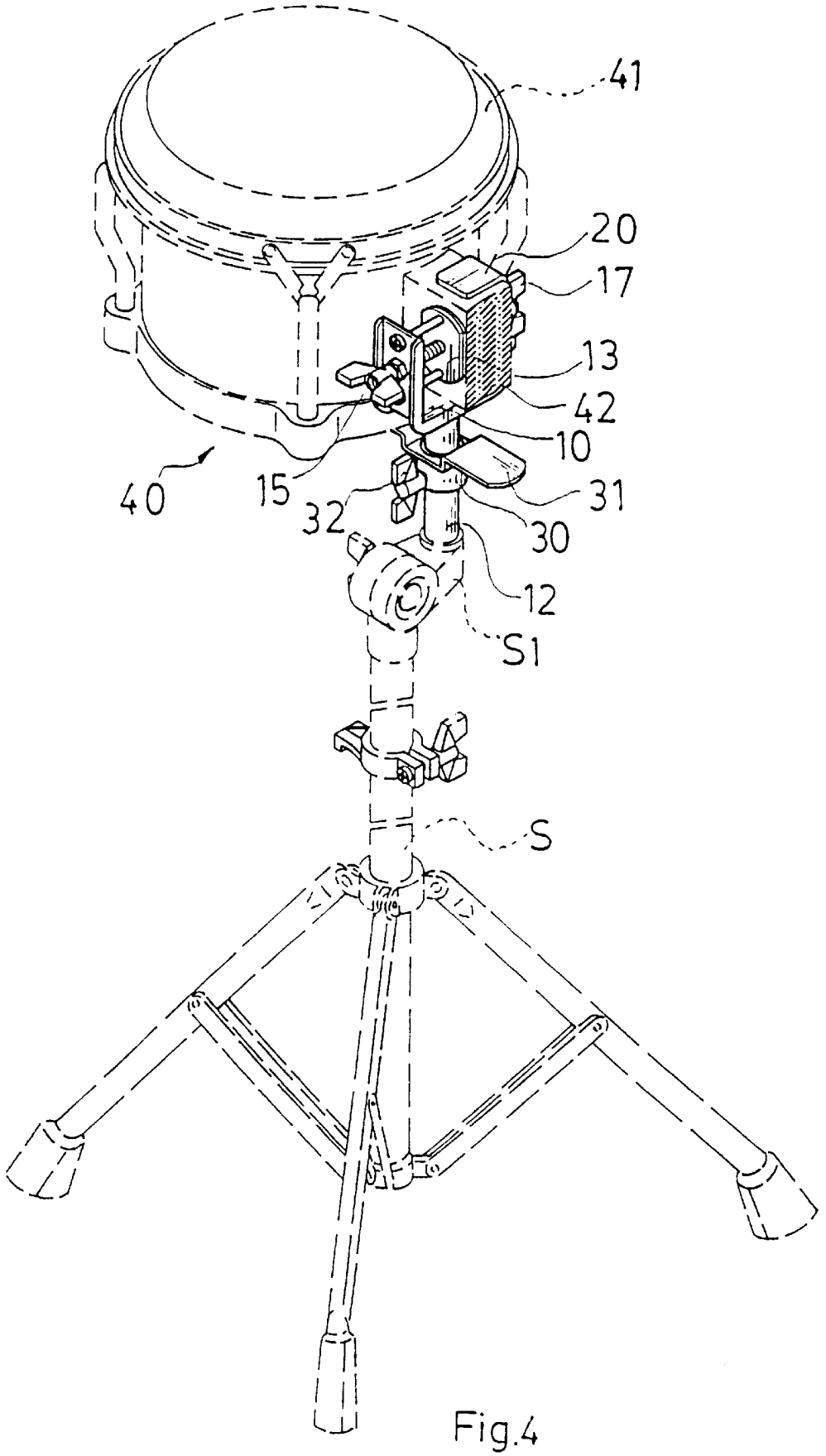
FIG. 4 is an installed view of the present invention.
Figure 5:
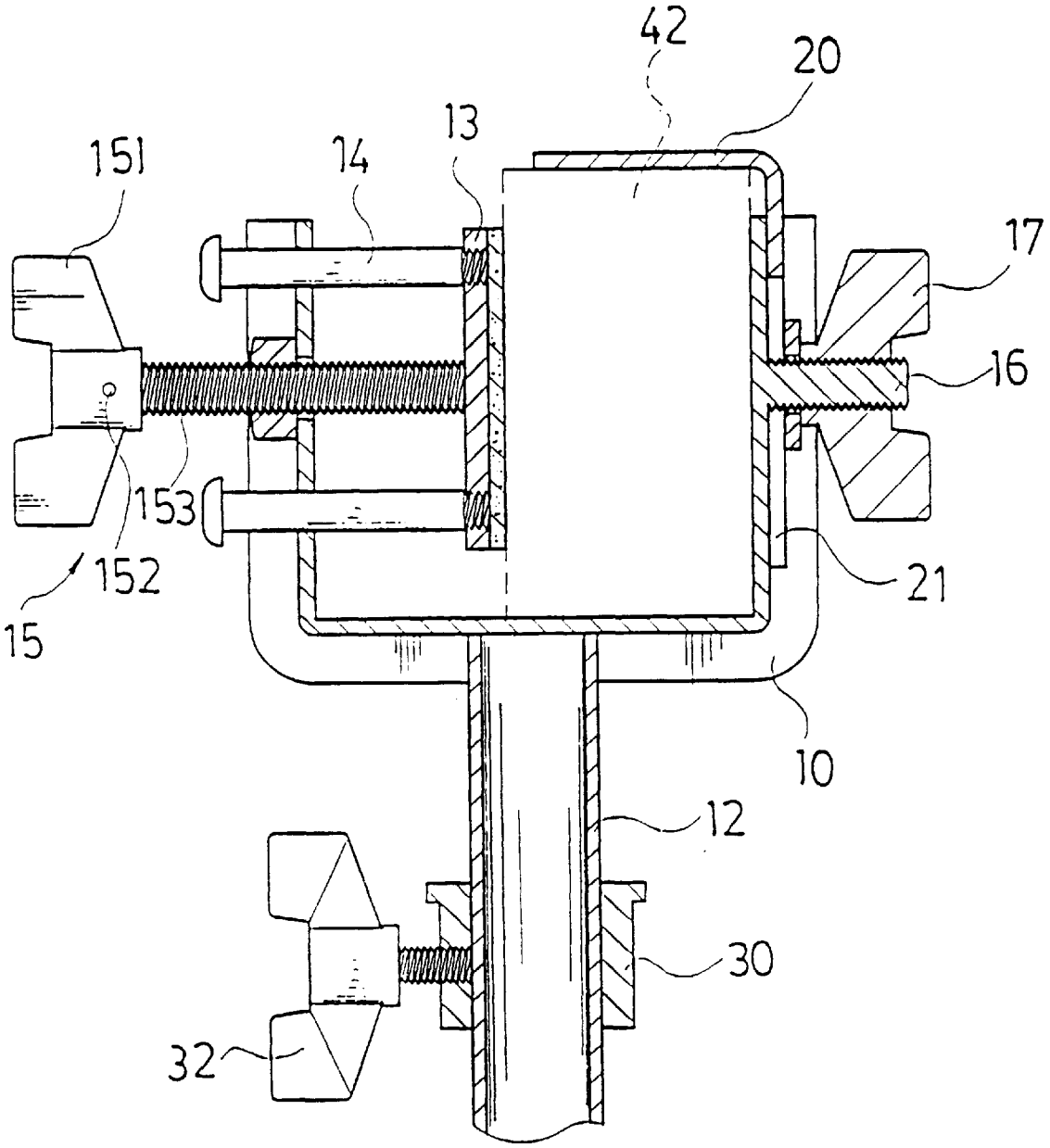
FIG. 5 is a sectional view taken along line 5—5 of FIG. 3.
Figure 6:
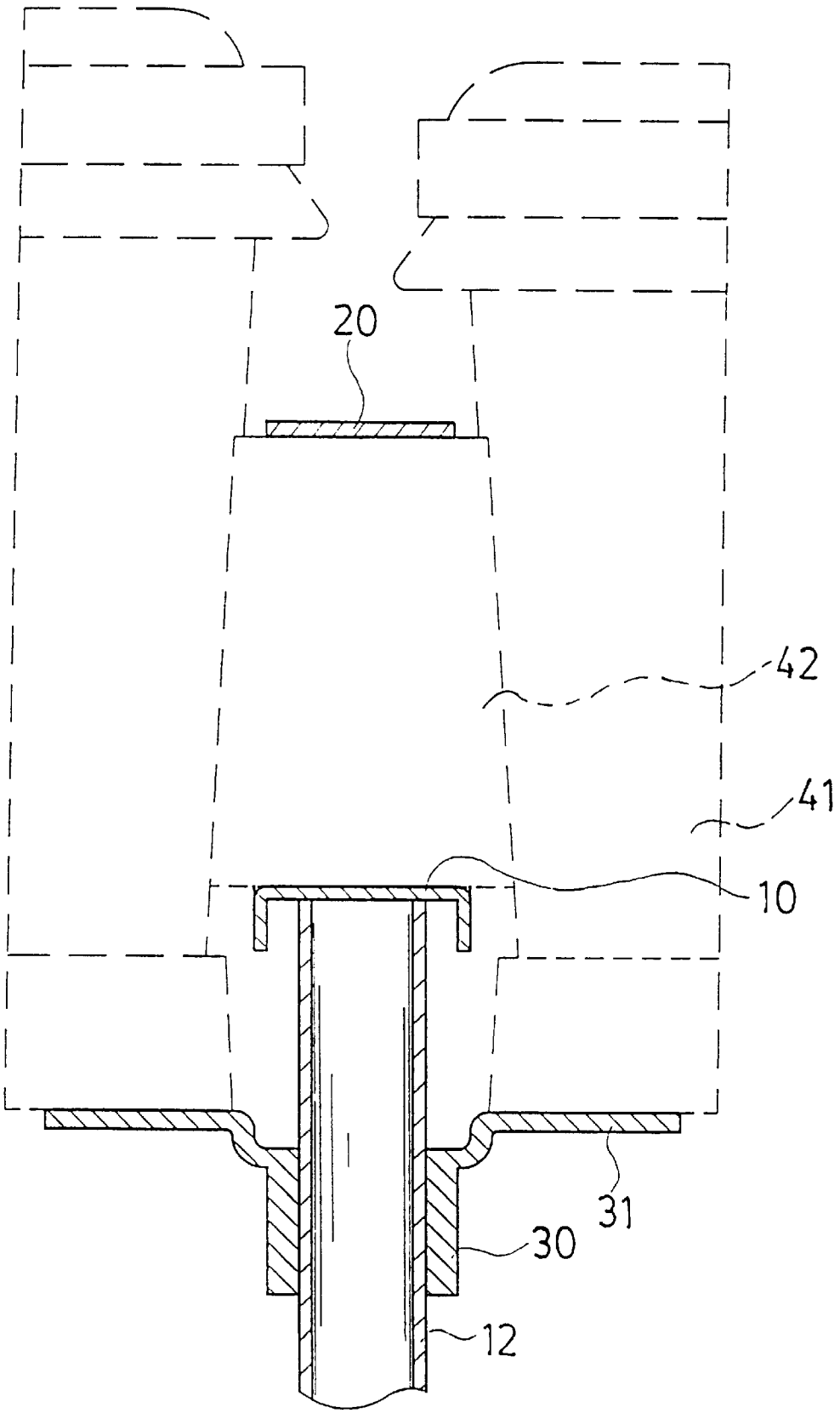
FIG. 6 is a sectional view taken along line 6—6 of FIG. 3.

Referring to FIGS. 5 and 6 and FIG. 4 again, the supporting member 30 is fastened to the mounting rod 12, then the mounting rod 12 is fastened to the angle adjustable connector SI of the tripod S, and then the block 42 between the two drums 41 of the bongos 40 is set in the holder base 10 and the tightening up wing screw 32 is fastened tight, permitting the two drums 41 of the bongos 40 to be supported on the wings 31 of the supporting member 30, then the holding down device 15 is fastened up to force the packing plate 13 against the block 42, enabling the block 42 to be fixed between the packing plate 13 and one vertical side wall (the first vertical side wall) of the holder base 10, and then the clamping plate 20 is fixed to the holder base 10 with its horizontal section stopped at the top side of the block 42. When installed, the drums 41 of the bongos 40 are firmly retained in place for beating.

Figure 7:
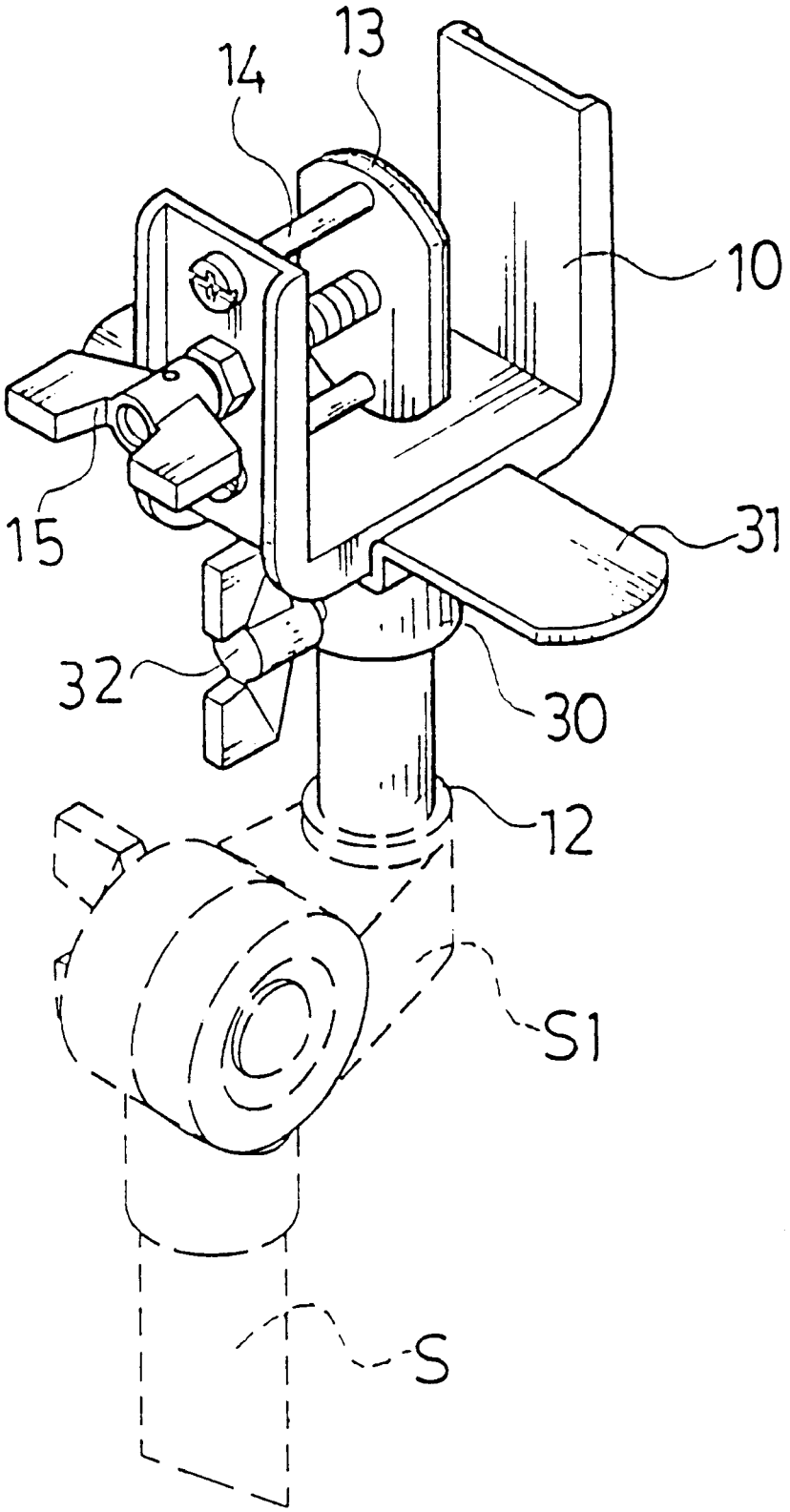
FIG. 7 shows an alternate form of the present invention.

Referring to FIG. 7, the aforesaid clamping plate 20 and the wing nut 17 may be eliminated. This arrangement can still hold the bongos firmly in place.

What the invention claimed is:

1. A bongos holder used for holding a bongo for beating, comprising:

a holder base for holding the block between the two drums of a bongo, said holder base comprising a horizontal bottom wall, two vertical side walls raised from said horizontal bottom wall at two opposite sides and arranged in parallel, a screw rod perpendicularly raised from one of said two vertical side walls on the outside, and a downward mounting rod perpendicularly downwardly extended from said horizontal bottom wall for connection to a tripod;

a packing plate coupled to one vertical side wall of said holder base by two bolts and moved with said bolts relative to the other vertical side wall of said holder base;

holding down means mounted on one vertical side wall of said holder base and driven to force said packing plate against the block between the drums of the bongos being installed in said holder base;

a clamping plate fastened to the screw rod at one vertical side wall of said holder base and fixed at the desired elevation by a wing nut to hold the block of the installed bongos in said holder base, said clamping plate having a vertical section attached to one vertical side wall of said holder base, a horizontal section stopped at the block of the installed bongos at a top side, and a downwardly extended mounting slot coupled to the screw rod at one vertical side wall of said holder base; and a supporting member mounted around said mounting rod and fixed thereto at the desired elevation by a tightening up wing screw, said supporting member having two side wings, which support the drums of the bongos being installed in said holder base.

2. The bongos holder of claim 1 wherein the two vertical side walls of said holder base each have two guard flanges perpendicularly raised from the border thereof at two opposite sides.

3. The bongos holder of claim 1 wherein said holding down means is comprised of a screw rod threaded into a screw hole at one vertical side wall of said holder base and stopped against said packing plate, a wing nut threaded onto one end of said screw rod outside said holder base, and a lock pin fastened to the wing nut and screw rod of said holding down means to fixedly secure the wing nut and screw rod of said holding down means together.

4. The bongos holder of claim 1 wherein said packing plate is comprised of a rigid base layer fastened to said bolts, and a flexible cover layer covered on said rigid base layer.

* * * * *